United States Patent [19]

Suzuki

[11] 4,361,417

[45] Nov. 30, 1982

[54] OIL-COOLED COMPRESSOR

[75] Inventor: Toshitsugu Suzuki, Tokyo, Japan

[73] Assignees: Hitachi, Ltd., Tokyo; Tokico Ltd., Kanagawa, both of Japan

[21] Appl. No.: 155,087

[22] Filed: Jun. 2, 1980

[30] Foreign Application Priority Data

Jun. 12, 1979 [JP] Japan ..... 54-73820

[51] Int. Cl.[3] ..... F04B 49/06

[52] U.S. Cl. ..... 417/13; 417/18; 417/44; 417/295

[58] Field of Search ..... 417/18, 13, 38, 32, 417/44, 295, 306

[56] References Cited

U.S. PATENT DOCUMENTS

| | | | |
|---|---|---|---|
| 2,137,221 | 11/1938 | Aikman | 417/18 X |
| 3,411,313 | 11/1968 | Brown et al. | 417/18 X |
| 3,602,610 | 8/1971 | Bloom | 417/295 X |
| 3,788,776 | 1/1974 | Post et al. | 417/295 |
| 4,227,862 | 10/1980 | Andrew et al. | 417/12 |

*Primary Examiner*—Carlton R. Croyle
*Assistant Examiner*—Edward Look
*Attorney, Agent, or Firm*—Wenderoth, Lind & Ponack

[57] ABSTRACT

An oil-cooled compressor including a main body driven by a motor for compressing gas and being cooled by oil, an oil tank for removing oil from the gas compressed in the main body and discharged therefrom, and a suction mechanism for supplying oil from the oil tank and gas into the main body. The suction mechanism includes a suction gas throttling mechanism, operable in response to the pressure of the compressed gas discharged from the main body. The motor is controlled by a temperature switch responsive to the temperature of the oil and a pressure switch which is responsive to the pressure of the compressed gas only at a pressure range which is lower than that of the compressed gas actuating the suction gas throttling mechanism.

5 Claims, 3 Drawing Figures

MOTOR 2 {ON OFF
PRESSURE SWITCH 20 {CLOSE OPEN
PRESSURE SWITCH 19 {OPEN CLOSE
TEMPERATURE SWITCH 21 {OPEN CLOSE
PRESSURE
P3
P'3
P2
P1
CLOSE OPEN } RELEASE VALVE 22
SMALL LARGE } SUCTION VALVE 3
T1
TEMPERATURE
α
β
A
B
C
D
TIME

OIL-COOLED COMPRESSOR

BACKGROUND OF THE INVENTION

This invention relates to improvements in oil-cooled compressors.

In conventional oil-cooled compressors, e.g. screw compressors, a gas, usually air, is compressed and is sucked into the compressor together with oil; the oil acts to cool and lubricate the main body of the compressor. The compressed gas discharged from the main body of the compressor is separated from the oil in an oil tank or a separator and is introduced into a pressure tank, while the oil separated from the compressed gas is cooled and, thereafter, introduced into the main body of the compressor.

When the pressure in the pressure tank elevates to a predetermined maximum pressure, a pressure switch used for detecting the pressure opens so as to stop a motor which is driving the main body of the compressor. When the pressure in the pressure tank decreases to a predetermined minimum pressure by consuming the pressurized gas in the pressure tank, the pressure switch closes so as to drive the motor.

The pressurized gas discharged out of the main body of the compressor has a high temperature and a high humidity and, when the temperature of the oil tank itself and the oil contained therein is at a relatively low temperature such as in an early stage of the operation, the gas is cooled in the oil tank, thereby generating condensation which causes rust in the oil tank and in the main body of the compressor and also deteriorates the characteristics of the oil. Namely, the temperature of the oil in the oil-cooled compressor should be low from in the viewpoint of cooling; however, it is necessary for the oil temperature to be high for preventing the generation of condensation, (the temperature being determined by the dew point of the compressed gas, and is about 50° C. or more when the pressure of the compressed air is 8–9 kg/cm$^2$). Therefore, there have been provided a temperature controlled valve located between the oil tank and an oil cooler, and a by-passing pipe connecting the temperature controlled valve with the suction port of the main body of the compressor by-passing the oil cooler, whereby the amount of oil flowing through the oil cooler is controlled in accordance with the temperature of the oil.

However, in the aforesaid prior art device, the temperature of the oil does not quickly elevate from a low temperature such as a room temperature to a desired minimum operating temperature such as the temperature corresponding to the dew point of the compressed gas. Particularly, when the operation of the motor is controlled by the pressure switch, the duration of the operation of the motor is relatively short; thus, the temperature of the oil does not elevate to the desired minimum operating temperature in a short period of time. Particularly, when the pressure in the reservoir tank is near to the maximum pressure, the duration of the operation of the motor decreases accordingly, and the oil temperature will not rise to the desired operating temperature.

SUMMARY OF THE INVENTION

One object of the invention is to solve the aforementioned problem and, according to the present invention, the amount of gas being sucked into the compressor main body is controlled until the oil temperature elevates to a predetermined level, thereby controlling the pressure of the gas being compressed, and maintaining the operation of the compressor main body so that the temperature of the oil can rise in a short period of time.

BRIEF DESCRIPTION OF THE DRAWINGS

The invention will further be explained hereinafter, by way of example, with reference to the accompanying drawings, in which.

DETAILED EXPLANATION OF THE PREFERRED EMBODIMENTS

Figure 1:
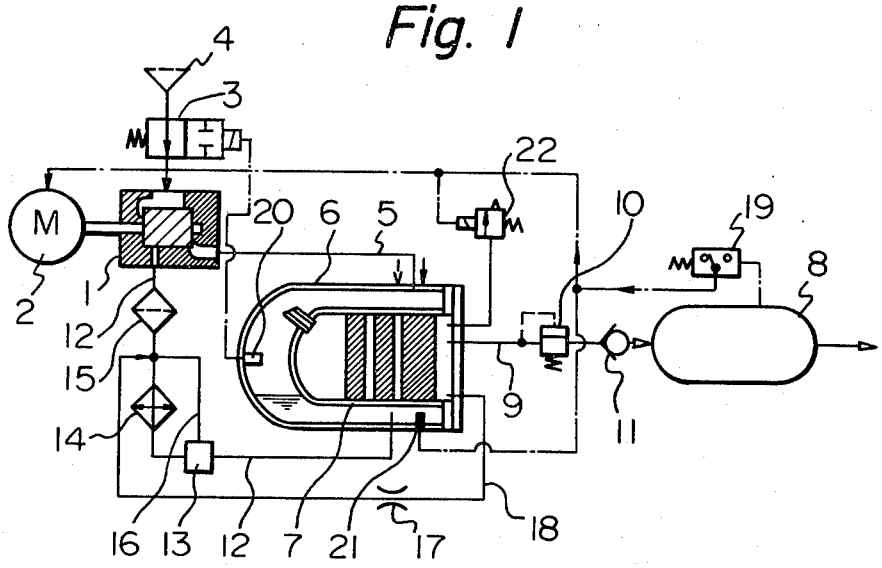
FIG. 1 is a schematic view of an oil-cooled compressor according to the present invention.

The oil-cooled compressor shown in FIG. 1 comprises a main body 1 and a motor 2 driving the main body 1. The main body 1 consists of intermeshing screw-type rotors or a vane-type rotor, and a casing receiving therein the rotors or the rotor. On the suction side of the compressor main body 1, is connected to a suction filter 4 through an electromagnetic suction valve 3 of the variable throttle type whose opening is throttled or decreased by exciting the valve 3. A discharge pipe 5 extends from the discharge side of the compressor main body 1 to the interior of an oil tank 6 and above the level of the oil received in the tank 6. An oil separator 7 is incorporated in the oil tank 6 and above the level of the oil. A pressure tank or a reservoir tank 8 for storing therein the compressed gas is connected to the oil separator 7 through a line 9 which incorporates therein a pressure retaining valve 10 and a check valve 11 located sequentially from the oil separator 7 to the pressure tank 8. An oil line 12 extends from the bottom portion of the oil tank 6 to the suction side of the compressor main body 1 and, there are provided in the oil line 12 sequentially from the oil tank 6, a temperature control valve 13, an oil cooler 14, and an oil filter 15. A by-pass pipe 16, for by-passing the oil cooler 14, is connected to the temperature control valve 13 and to the line 12 between the oil cooler 14 and the oil filter 15. The line 12 between the elements 14 and 15 is also connected to the oil separator 7 through an oil returning line 18 having a restrictor 17.

A pressure switch 19 is connected to the pressure tank 8 and acts in response to the pressure in the tank 8. The pressure switch 19 closes when the pressure in the tank 8 decreases to a predetermined minimum pressure $P_1$ and opens when the pressure exceeds a predetermined maximum pressure $P_2$, wherein $P_2 > P_1$. An auxiliary pressure switch 20, a temperature switch 21 and a release valve 22 is provided in the oil tank 6. The auxiliary pressure switch 20 is a normally open type and closes when the pressure in the oil tank 6 exceeds a predetermined high pressure $P_3$ ($P_3 > P_2$), and the temperature switch 21 is a normally close type and opens when the temperature exceeds a predetermined temperature $T_1$ which is preferably higher than the dew point of the compressed gas, and the release valve 22 is a normally close type electromagnetic valve and opens in the excited condition.

The pressure switch 19 and the temperature switch 21 cooperate to control the motor 2 and, also, control the release valve 22 in response to the operational condition of the motor 2. The auxiliary pressure switch 20 controls the suction valve 3.

Figure 2:
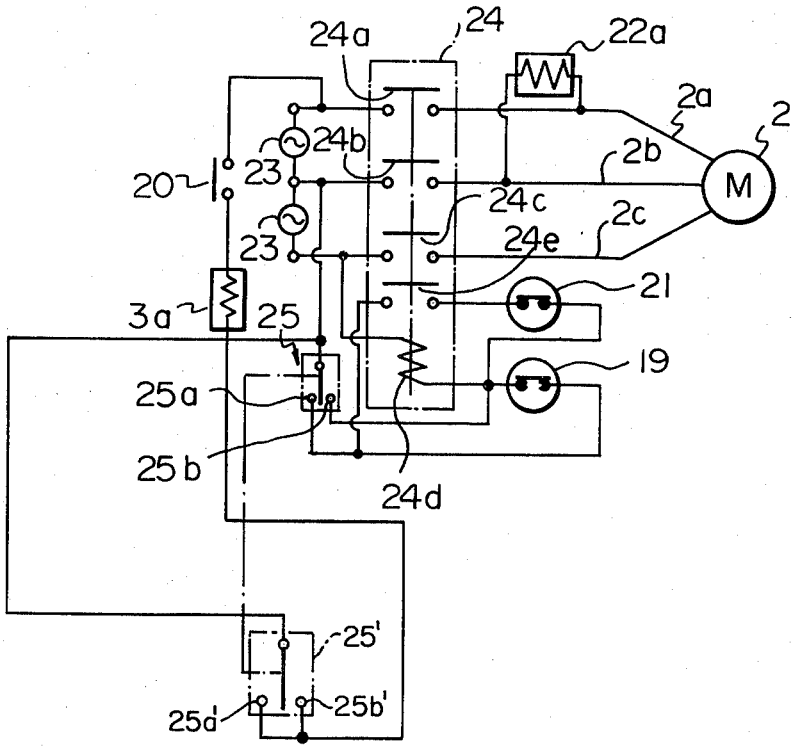
FIG. 2 is a wiring diagram of the electric circuit.

FIG. 2 shows the wiring diagram of the elements 2, 3, 19, 20, 31 and 22, and will now be explained. The motor 2 is of a three phase AC type with first, second and third lines 2a, 2b and 2c being connected to an electric source 23 through normally open contacts 24a, 24b and 24c of an electromagnetic switch 24. Between the second and third lines 2b and 2c and between the switch 24 and the electric source 23, there is connected a three position, two-throw type main switch 25 with one of the contacts 25a being connected in series to the pressure switch 19 and to the coil 24d of the electromagnetic switch 24, and the other contact 25b being connected to the coil 24d by-passing the pressure switch 19. The temperature switch 21 is connected in series with contact 24e of self-retaining circuit of the switch 24. Furthermore, the auxiliary pressure switch 20 and a coil 3a of the suction valve 3 are connected in series between the first line 2a of the motor 2 on the side of the source 23 relative to the switch 24 and two contacts 25a' and 25b' of an auxiliary section 25' of the main switch 25. A coil 22a of the release valve 22 is connected between the first and second lines 2a and 2b of the motor 2 on the side of the motor with respect to the switch 24.

The operation will hereinafter be explained with reference to FIGS. 2 and 3.

Assuming that the temperature of the oil is near to the room temperature and the tank 8 is empty. The main switch 25 is switched to the contact 25a, and then, since the pressure switch 19 is closed, the coil 24d of the electromagnetic switch 24 is excited so as to close the contacts 24a, 24b, 24c and 24e; the motor 2 is thereby energized and the coil 22a is excited so as to close the release valve 22. The compressor main body 1 is driven. Since the auxiliary pressure switch 20 is not actuated, the suction valve 3 is fully open, and therefore, a large amount of gas is sucked through the filter 4 and into the compressor main body 1 (together with the oil flowing through the line 12) and is compressed in the compressor main body 1. The gas, usually air, is compressed in the compressor main body 1 together with oil heated by the compression and the combination is discharged into the upper portion of the oil tank 6. The compressed gas is separated from the oil in the oil tank 6 and by the oil separator 7 and is introduced into the tank 8 and stored therein. The oil separated from the gas is circulated through the compressor main body 1 for lubricating and cooling the compressor; however, since the oil temperature is relatively low, the oil substantially flows through the by-pass line 16 to the compressor main body 1.

Figure 3:
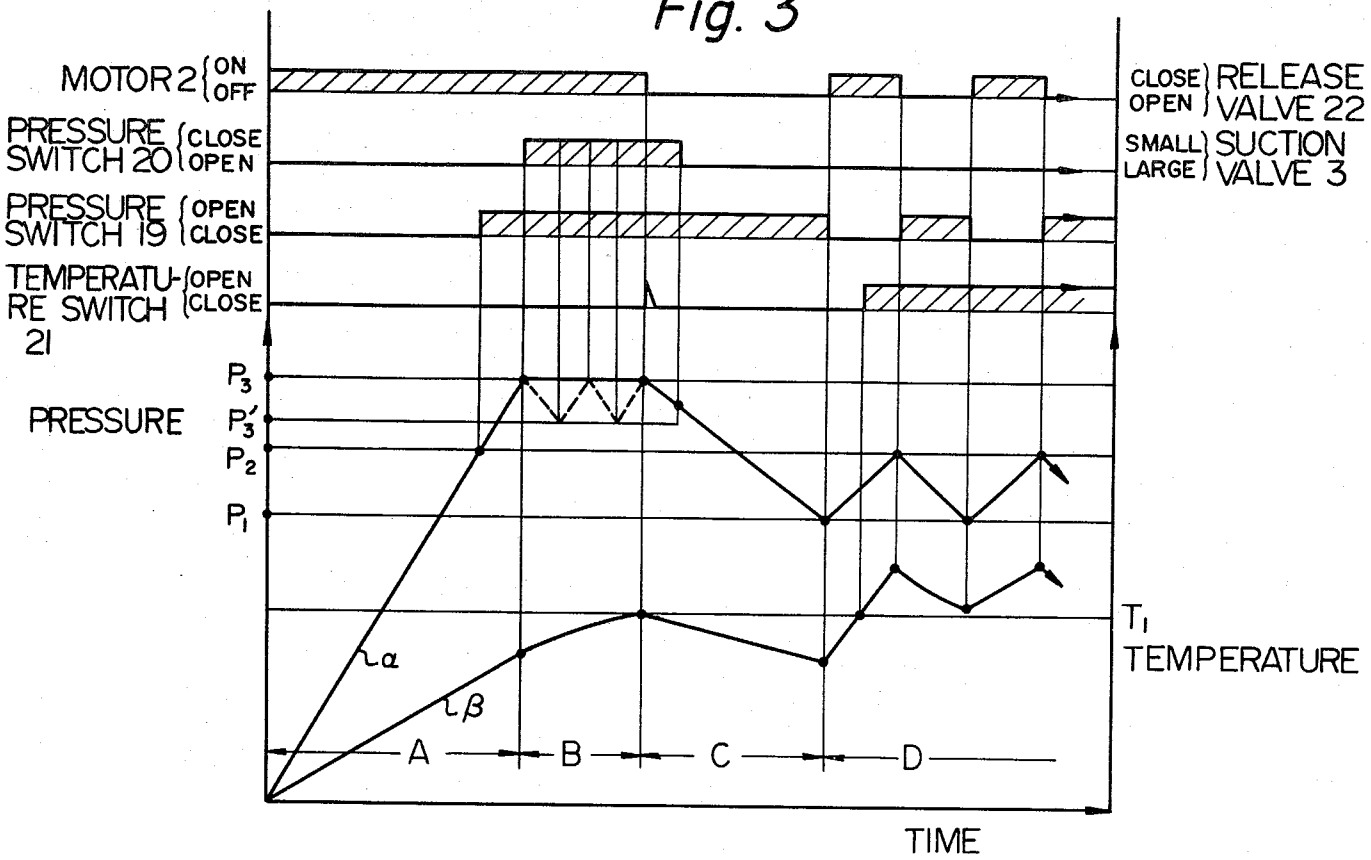
FIG. 3 is a diagram showing the operational sequence of the compressor of FIG. 1.

The initial operation condition described as above is depicted by zone A in FIG. 3 wherein the pressure increases along line $\alpha$ and the oil temperature increases along line $\beta$ in FIG. 3. It will be noted that the pressure increases to $P_2$ before the temperature reaches to $T_1$. When the pressure increases to $P_2$, the pressure switch 19 opens; however, the temperature switch 21 in the self-retaining circuit of the electromagnetic switch 24 is maintained in the closed condition, and the motor 2 is maintained in the energized condition so as to compress the gas.

At the last stage of zone A, the pressure rises to $P_3$ with the oil temperature being lower than $T_1$, to the auxiliary pressure switch 20 closes, thereby exciting the coil 3a of the suction valve 3 so as to reduce the opening of the valve 3. The amount of gas sucked into the compressor is decreased and the compressor operates at one type of unloaded condition, with the gas not being substantially compressed and the oil being circulated through the compressor main body. The heat generated in this stage is about 30–70% as compared with the normal operating condition thus, the oil temperature continues to rise at a reduced rate as shown in zone B in FIG. 3.

When the pressurized gas is utilized at that condition, the pressure decreases along the broken lines in FIG. 3, and when the pressure decreases to $P_3'$, the auxiliary switch 20 opens to open so as the suction valve 3, thereby restoring the normal operating condition so that the pressure again increases to $P_3$ along the broken lines in FIG. 3.

When the oil temperature elevates to $T_1$, the temperature switch 21 acts to open, thereby opening respective contacts 24a, 24b, 24c and 24e of the electromagnetic switch 24. The compressor main body 1 stops and the release valve 22 opens. The pressure in the oil tank 6 slowly decreases when the compressor main body 1 stops and the release valve 22 opens; however, the pressure tank 8 is separated from the oil tank 6 by the check valve 11; thus, the pressure in the tank 8 is controlled by the consumption of the pressurized gas.

The oil temperature in the oil tank 6 decreases below the temperature $T_1$ according to the release of the gas through the release valve 22, thereby closing the temperature switch 21; however, the motor 2 is not energized until the pressure switch 19 closes. It will be noted that the temperature switch 21 operates so as to stop the motor 2 but does not act to start the motor 2.

When the pressure in the tank 8 decreases to $P_1$, the pressure switch 19 closes, thereby energizing the motor 2 so as to drive the compressor main body 1. At that condition, the auxiliary pressure switch 20 is open and the suction valve 3 is in the fully opened condition; thus, in accordance with the operation of the compressor main body 1, the pressure in the tank 8 and the oil temperature tend to increase as shown in the initial stage of the zone D of FIG. 3. Thereafter, the oil temperature soon exceeds $T_1$, whereby the temperature switch 21 does not act to postpone the stoppage of the motor 2. The operation of the compressor is solely controlled by the pressure switch 19 so that the pressure in the tank 8 is maintained between $P_1$ and $P_2$. The release valve 22 opens or closes in response to the stop or start of the motor 2. The temperature of oil is controlled by the amount of oil passing through the oil cooler 14 or by-passing the oil cooler 14.

In FIG. 3, zone C denotes a transient condition between zones B and C.

In the aforesaid description, the main switch 25 is connected to one of the contacts 25a, and the case when the main switch 25 is connected to the other contacts 25b will now be explained. The coil 24d is energized thus the motor 2 is driven irrespective to the switches 19 and 21.

When the pressure increases to $P_3$, the opening of the suction valve 3 decreases so that the compressor works at one kind of the unloaded operation. When the pressure in the oil tank 6 decreases below $P_3$, the opening of the suction valve 3 increases, thus enabling the normal operation of the compressor.

The invention is not limited to specified embodiments described as above, and includes following modifications.

(a) It is not necessary to provide the release valve 22; however, the valve 22 can effectively reduce the starting load of the compressor by releasing the pressure in the oil cooler.

(b) The pressure switch 19 may be provided on suitable locations such as on the oil tank 6 or the like other than the pressure tank 8.

(c) The suction valve 3 may be replaced by a pressure responsive valve for directly receiving the pressure of the compressed gas or the pressure of oil which receives the pressure of the compressed gas, with the auxiliary pressure switch 20 being omitted.

As described heretofore, the compressor according to the present invention is formed so as to continuously operate until the temperature of the oil rises to a predetermined level, with the pressure in the discharged gas being restricted below a predetermined pressure; thus, it is possible to quickly increase the oil temperature, thereby restricting the generation of condensation. Furthermore, the opening of the suction valve is restricted so as to restrict the elevation of the pressure in the initial stage of operation until the temperature of the oil is elevated to a predetermined level; thus, as compared with a prior art compressor wherein the pressure is controlled by releasing a portion of the compressed gas, it is possible to reduce the generation of acoustical raise and to quickly elevate the oil temperature by avoiding the dissipation of the heat accompanied with the release of the compressed gas.

The compressor according to the present invention is advantageous in practical use since a usual pressure responsive type operation can be effected when the oil temperature exceeds a predetermined temperature.

What is claimed is:

1. An oil-cooled compressor system comprising a compressor driven by a motor for compressing gas and being cooled by oil, an oil tank having an oil separator for removing oil from the gas which has been compressed in the compressor and discharged therefrom, oil in said oil tank being supplied to a suction side of said compressor, a means for throttling gas sucked into said compressor when the pressure of the gas discharging from said compressor exceeds a predetermined first pressure, a pressure switch acting at a second predetermined pressure of the gas at a different point in said system downstream of said compressor, said second pressure being lower than said first pressure, a temperature switch means which operates when the temperature of said oil in said oil tank exceeds a predetermined temperature, and a circuit connected to said pressure switch and said temperature switch means for controlling the operation of said motor so as to stop said motor when the pressure of the gas discharging from said compressor exceeds said second pressure and when the temperature of the oil exceeds said predetermined temperature.

2. An oil-cooled compressor system as set forth in claim 1, wherein said means for throttling gas comprises an electromagnetic suction valve of a variable opening type, and an auxiliary pressure switch which controls said suction throttling valve.

3. An oil-cooled compressor system as set forth in claim 1, wherein an electromagnetic switch actuated by said pressure switch is connected to an electric power circuiit of said motor, and wherein said temperature switch means is connected to a self-retaining circuit of said electromagnetic switch, thereby controlling the start of said motor solely by said pressure switch.

4. An oil-cooled compressor system as set forth in claim 3, wherein a main switch of a double throw type is connected to said electric power circuit of a coil of said electromagnetic switch, and wherein one contact point of said main switch is connected in series with said pressure switch and said coil and another contact point of said main switch is connected to said coil so as to bypass said pressure switch.

5. An oil-cooled compressor system as set forth in claim 1, wherein a release valve is provided in the line of pressurized gas for releasing the pressure, said release valve being controlled by said pressure switch and said temperature switch means.

* * * * *